United States Patent [19]

Geyssel

[11] Patent Number: 4,584,046

[45] Date of Patent: Apr. 22, 1986

[54] DEVICE FOR ATTACHING ARTICLES TO PACKAGES, BOTTLES AND OTHER OBJECTS

[76] Inventor: Jurgen Geyssel, Kirchweg 76, 5000 Cologne 40, Fed. Rep. of Germany

[21] Appl. No.: 462,613

[22] Filed: Jan. 31, 1983

[30] Foreign Application Priority Data

Feb. 5, 1982 [DE] Fed. Rep. of Germany ..... 3204011

[51] Int. Cl.[4] ..... B32B 31/00; G05G 15/00; B65C 9/40

[52] U.S. Cl. ..... 156/358; 156/363; 156/539; 156/567; 156/517; 156/521; 156/353

[58] Field of Search ..... 156/363, 361, 358, 357, 156/521, 566, 567, 568, 571, 541, 542, 362, 539, 517, 353

[56] References Cited

U.S. PATENT DOCUMENTS

| | | | |
|---|---|---|---|
| 3,635,779 | 1/1972 | Cooper | 156/361 |
| 3,707,423 | 12/1972 | Davies et al. | 156/517 |
| 3,890,192 | 6/1975 | Della Vite | 156/571 |
| 3,970,506 | 7/1976 | Kwan et al. | 156/358 |
| 3,984,277 | 10/1976 | French et al. | 156/497 |
| 4,242,168 | 12/1980 | Carter | 156/357 |
| 4,293,369 | 10/1981 | Dilot et al. | 156/521 |
| 4,321,103 | 3/1982 | Lindstrom et al. | 156/363 |
| 4,336,095 | 6/1982 | Hoffmann | 156/542 |

FOREIGN PATENT DOCUMENTS

| | | | |
|---|---|---|---|
| 0035645 | 2/1981 | European Pat. Off. . | |
| 898444 | 11/1959 | United Kingdom . | |
| 2031839 | 4/1980 | United Kingdom | 156/568 |

*Primary Examiner*—Edward Kimlin
*Assistant Examiner*—L. Falasco
*Attorney, Agent, or Firm*—Body, Vickers & Daniels

[57] ABSTRACT

A device for attaching articles (11) to packages (12) which are passed to the applicator device (10) at irregular intervals. When this is done the articles (for example, drinking straws (11)), are thrust against the package (12) by means of rotatable applicator arms (41). The applicator arm (41) is tilted against the action of a pull-off spring (51) by a burst of compressed air that acts on the arm (41) for a brief period so that it moves back into its initial position immediately after pressing against the package (12).

The applicator device (10) can be tilted about two perpendicular directions and can be secured in order that the drinking straws (11) can be secured in different directions and on variously inclined surfaces of the package (12).

11 Claims, 10 Drawing Figures

DEVICE FOR ATTACHING ARTICLES TO PACKAGES, BOTTLES AND OTHER OBJECTS

BACKGROUND OF THE INVENTION

This invention relates to a device for attaching articles such as labels, drinking straws or the like to packages, bottles or other objects, these being moved at intervals past the device which prepares the objects that are to be attached individually by the use of a feed system. When labels are attached to industrial goods that are discharged from a machine or when drinking straws are attached to containers that are filled with a liquid the difficulty exists that the objects, to which the labels or drinking straws, respectively, or the like are to be attached often leave the manufacturing or package machinery at irregular intervals on the conveyor belt and thus have to be placed in regular order in the feed flow before they can be subjected to further steps in the processing sequence.

It is a well known fact that objects moved up on a conveyor belt and situated on this at irregular intervals can first be allowed to run up against a blocking plate in order that several of the objects will be pressed closely together. These are then released transversely to the conveyor belt individually either at equal time periods onto another conveyor belt which passes them along for further processing or they are moved into the cells of a compartmentalized wheel that rotates past the processing station compartment by compartment. The articles that are to be applied to the individual objects, such as labels, drinking straws, etc., are then fastened to each object when it is stationary or else secured to it in some other manner.

The compacting and the subsequent transportation of the articles that are once again moving individually requires additional expenses for machinery and construction and these increase the price of the system to a very great degree and cause a drop in the rate of production.

SUMMARY OF THE INVENTION

It is the task of this invention to create a system with which objects, in particular drinking straws, labels, or the like, can be attached to objects such as packages, bottles, bags, etc., these being moved past on a conveyor belt at irregular intervals and/or at different speeds, and to do this always at the same place.

This task is solved by means of this invention in such a manner that an applicator that can be moved against the object is provided, this then thrusting the article to be attached against the object and then operating against a spring by a thrust device that is controlled by the object that is being moved past.

This configuration entails the advantage that the objects that are ejected from a processing or packing machine then moved at irregular intervals do not first have to be brought to equal distances from each other but can be provided continuously with the articles that are to be attached on their exteriors as they move past. Thus it is neither necessary to maintain the objects at equal intervals from each other, neither is it necessary to stop the progress of the object during the application of the articles. Under the terms of this invention this is made possible by the fact that the thrusting device only acts for a brief time on the applicator and then disappears once again before the applicator together with the article which is to be applied impacts on the object. The recoil and the action of the spring means that there is practically no relative shift between the object that is moving past and the article that is to be applied to it and the control that is activated by the object moving past itself means that the article is always placed in the same sport on the object no matter at what speed and at what intervals these pass by the device. It is expedient that the thrusting device has an air jet that produces an air thrust against the applicator. Such an air thrust system operates with practically no inertia and the air thrust moves the applicator element only in the direction in which it thrusts the article against the object. Then the very brief air pulse will fade so that the recoil and the recoil spring of the applicator element move back very rapidly and precisely to their initial position, in which regard it is important that the thrust device only acts for a brief period on the applicator and then disappears once more.

It is expedient that the applicator element can be tipped in several directions in order that the article that has been made ready can be applied in various positions and on variously configured objects as selected. In this regard it is particularly expedient if the thrust device, the applicator element and the drive system are installed together on a carrier that can be tilted about two perpendicular axes and which can be secured. The parts required for the thrust and the applicator element will then always be in the same spatial position relative to each other in which regard the applicator element can be placed in any desired angular position against the objects to which the articles are to be secured.

The applicator element can be a swivelling applicator lever that can be swivelled by the thrust device against the action of a spring. However, it is also possible to configure the applicator element as an axially moveable applicator push rod, which can be thrust by the thrust device against the object against the action of a spring.

In order to control the forward thrust and switch on the applicator element at the very moment at which the object that is to be provided with the article is opposite the attachment device it is expedient that sensors be arranged in the path of movement of the object that is being moved past the device so that these sensors can recognize the object and then control the drive of the thrust device and/or the thrust advance system.

It is particularly expedient if the forward thrust device has a compartmentalized wheel in the cells of which, that are arranged around the circumference, are contained the articles that are to be applied and that these can be picked up by the applicator element which slides in at least one circumferential groove that has an open edge, this being arranged in the area of the cells. The applicator element then always has the same initial position and needs to move only a short distance in order to apply the article against the object that is being moved past these being held in the partially evacuated cells of the compartmentalized wheel.

The applicator element can also be configured as a tipping lever, one arm of which engages in the circumferential groove of the compartmentalized wheel and the other arm of which is acted on by the thrust device. In this regard it is expedient if one arm of the applicator lever is pressed constantly by a spring against the outlet opening of the air jet.

In order that the applicator lever holds the article that is to be applied on each occasion securely and moves rapidly to the appropriate object without it being tilted it is expedient that the compartmentalized wheel of the forward thrust device has two circumferential grooves that are an interval from each other in which the two ends of the one fork-shaped arm of the applicator lever lie.

If the applicator element is configured as an applicator thrust rod at one end this will have the thrust element that picks up the article that is to be applied on each occasion and at the other end will have a blocking plate that is arranged in front of the outlet opening of the air jet.

BRIEF DESCRIPTION OF THE DRAWINGS

Further features and advantages of the invention emerge from their subsequent description and from the drawings which illustrate a preferred exemplary version of the invention on the basis of one example. These drawings are as follows.

DESCRIPTION OF A PREFERRED EMBODIMENT

Figure 1:
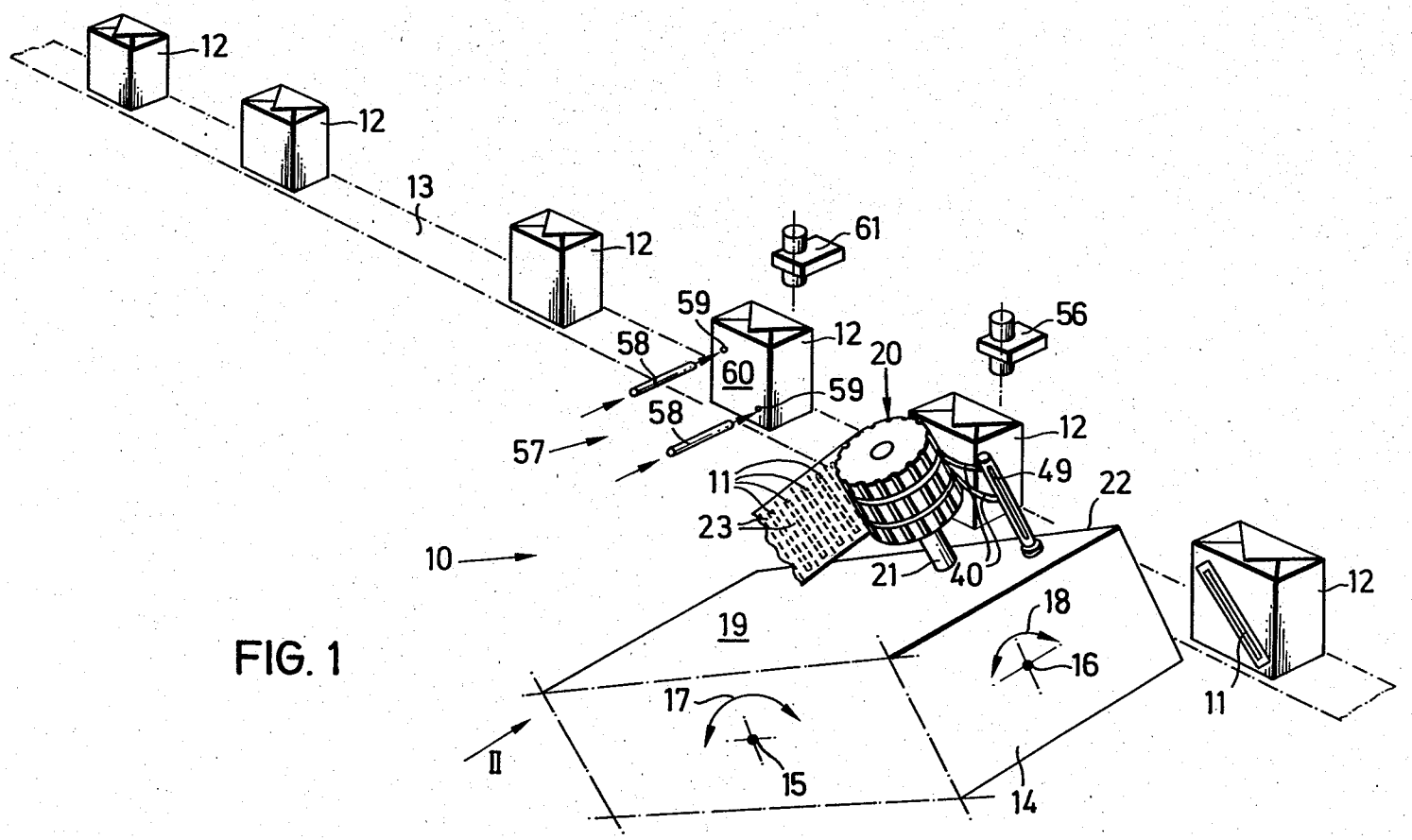
FIG. 1 A device for attaching drinking straws in a diagonal position on the outer surface of a package filled with a drink these being moved past the device on a conveyor belt, this being a schematic perspective drawing, FIG. 2 The object according to FIG. 1 in side elevation, FIG. 3 The article shown in FIG. 2 in partial front view in the direction of the arrow III, FIG. 4 The conveyor belt to move the drink packages and the device for attaching the drinking straws according to FIG. 3 in front view in the direction of the arrow IV, at enlarged scale, FIG. 5 The object shown in FIG. 3 in partial cross section on the line V—V, at enlarged scale, FIG. 6 A planned view of the article in FIG. 5.

In the drawings 10 indicates a device, with the articles 11, in this case a drinking straw that is contained in a paper tube, that are to be cemented on the objects 12 that pass the device 10; in this case these objects 12 are containers filled with a drink. The packages 12, that are rectangular, are filled in a packing machine (not illustrated here) with the drink and then pass at irregular intervals on a conveyor belt 13 which moves them continuously and preferably at a constant speed past the device 10 to a collection station (not illustrated here) where they are stacked and then delivered to a store or to a point of use.

The attachment device 10 is arranged at the level of the conveyor belt 13 and immediately adjacent to this. It consists of a carrier 14 for example a table plate, that can be tilted in the direction of the arrows 17 and 18 about two perpendicular axes 15 and 16 in a carrier frame 29 and can be secured in each tilted position. On the surface 19 of the carrier 14 there is a compartmentalized wheel 20 installed on an axis 21, perpendicular to the surface 19, in the vicinity of the edge 22 of the carrier that faces the conveyor 13 and this is installed in such a manner as to be capable of rotation and is driven by a stepper mechanism so as to rotate and can be switched incrementally.

The drinking straws 11 are in the compartmentalized wheel 20 and are contained in paper sleeves 23 which initially form a strip 24, that is drawn by a feed roller 25 over the guide rollers 26 and 27 and guided to the compartmentalized wheel 20. The feed roller 25 and one guide roller 26 are mounted on a carrier 28 in such a manner as to permit rotation and this carrier 28 is secured to the surface 19 of the carrier device 14 (FIGS. 2 and 3), whereas the guide roller 27 is installed in such a manner as to permit rotation parallel to the compartmentalized wheel 20 on the surface 19 of the carrier 14. The compartmentalized wheel 20, the guide rollers 26 and 27, and the feed roller 25 together form the feed system 30. They do not change their relative positions if the carrier 14 and the axes 15 and 16 are tilted.

Figure 5:
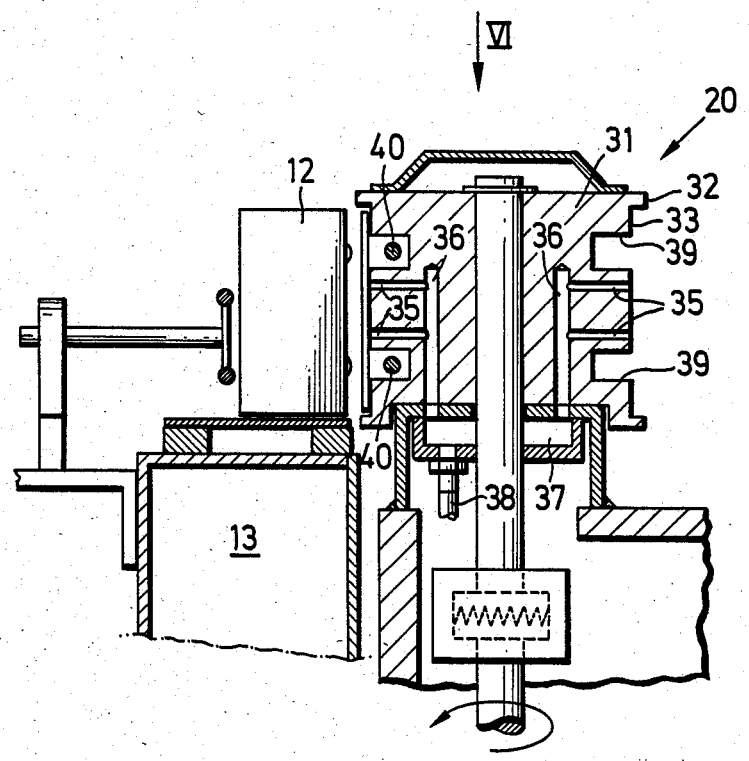
Figure 6:
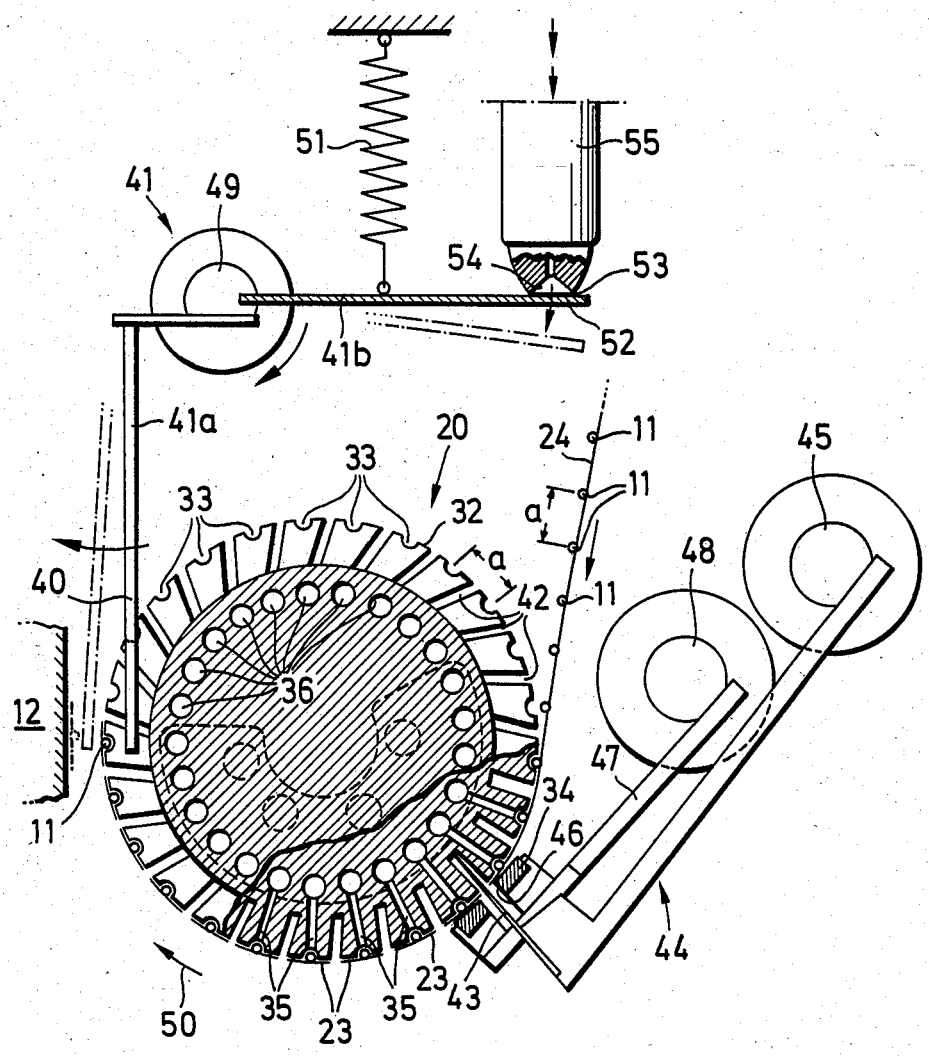

The compartmentalized wheel 20 is shown in greater detail in FIGS. 5 and 6. This wheel consists of a cylindrical body 31 which has a number of cells 33 on its outside surface 32 these being arranged at intervals from each other along the circumference and which are semicircular in cross section and match the cross section of the drinking straws 11. The interval a of the cells in the direction of the circumference corresponds to the interval a of the drinking straws 11 that are contained in the paper strip 24 this being drawn along by the feed roller 25 so that the drinking straws 11 that are surrounded by the paper strip 24 lie in the cells 33 of the compartmentalized wheel one after the other if the strip 24 passes between the outside surface 32 of the compartmentalized wheel and a pressure plate 34 that rests against this outside surface 32.

Each cell 33 is connected by radial drillings 35 and axial drillings 36 to a low pressure chamber 37 and this low pressure chamber is connected by a means of a vacuum liner 38 to a vacuum generator that is not shown in these illustrations.

In addition, the compartmentalized wheel 20 is provided with two annular grooves 39 that are separated from each other by an axial interval, and these are deeper than the cells 33. The two ends 40 of a fork-shaped arm **41*a* of an applicator arm 41** can slide in these annular grooves.

Between the cells 33 the compartmentalized wheel 20 has axially oriented slots 42 (FIG. 6) on its outer surface 32 in which the cutter blade 43 of a swinging cut-off knife 44 can enter; this is installed next to the compartmentalized wheel 20 on the surface 19 of the carrier 14 and is installed on a shaft 45 in such a manner as to be able to rotate. The cutter blade 43 operates in a slit 46 in the pressure plate 34. The cut-off knife 44 is used to cut the continuous paper strip 24 in which the drinking straws 11 are contained into individual paper strips 23 with which each drinking straw 11 is cemented to the package 12.

It can be seen from FIG. 6 that the pressure plate 34 is also mounted on an arm 47 and that this is mounted in the carrier 14 in such a manner as to be able to rotate around a shaft 48 and is pressed and sprung against the outer surface of the compartmentalized wheel 20.

Figure 4:
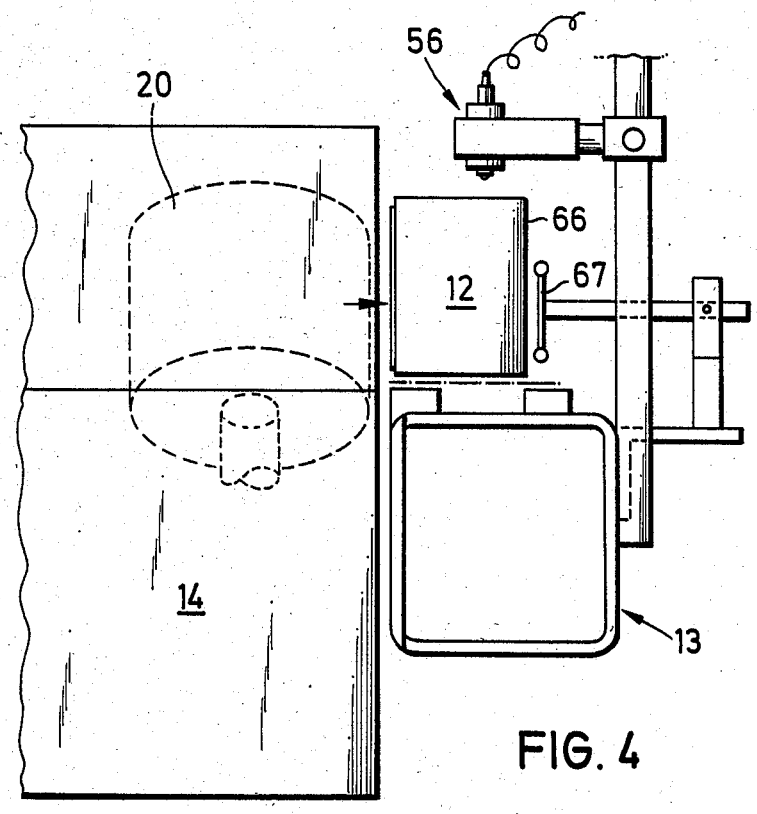

The applicator arm 41 that has already been mentioned is a two-armed tilt lever that is installed so as to be able to rotate with a shaft 49 next to the compartmentalized wheel 20 on the surface 19 of the carrier. One arm, **41*a*, extends approximately parallel to the conveyor belt 13; this is fork-shaped and engages with both its front ends 40 into the annular grooves 39 of the compartmentalized wheel 20 in such a manner that it lies between the drinking straws 11 that are held in the cells 33 by vacuum if the compartmentalized wheel 20 rotates in the direction of the arrow 50. The other arm, 41***b*, of the applicator arm 41 is acted on by the spring 51 that attempts to rotate the applicator arm 41 in FIG. 6 counter-clockwise and which presses the free end 52 of the arm 41*b* of the applicator lever 41 against the edge 53 of the outlet opening 54 of an air nozzle 55. The air nozzle 55 is connected to a compressed air supply (that is not shown here) by means of a controllable shut-off valve through which compressed air can be ejected in short bursts from the air nozzle 55 against the end 52 of the lever 41*b* of the applicator lever 41. The shut-off valve is controlled by means of a sensor 56, for example, a photoelectric cell (FIGS. 1 and 4), this being arranged above the conveyor belt 13 in the area of the attachment device 10 and which senses the package 12 that passes it and feeds a control pulse if required with a preset delay, to the air valve so that this valve opens for a brief period and a burst of compressed air and leaves the nozzle 55; this swings the applicator arm 41 counter-clockwise against the force of the spring 51, whereupon the front fork-shaped ends 40 of the arm 41*a* of the applicator lever 41 move outwards drinking straw 11 that is the furthest forward and then press this with its sleeve 23 against the package 12 that is moving directly in front of it.

An adhesive applicator is arranged adjacent to the conveyor belt 13 (this not being shown in the illustration) ahead of the applicator device 10 in the direction of movement of the conveyor belt 13 and this adhesive applicator places two spots of adhesive 59 through two nozzles 58 onto the side 60 of the edge 12 that faces the applicator device when the front edge of this packet passes the beam of light from the photoelectric cell 61 which then activates the cement applicator 57.

The device operates as follows:

As has been described above, the packages 12 that are disposed at irregular intervals on the conveyor belt 13 are moved at a constant speed in the direction of the arrow 65 to the applicator device 10. If a package 12 passes the cementing station 57 and activates the photoelectric cell 61 with its forward edge two spots of cement 59 are sprayed through the cementing nozzles 58 onto the side 60 of the package. When this is done the spots of cement are so arranged that they are located in the front upper and rear lower corners of the surface 60 since the length of the drinking straw 11 is somewhat greater than the height of the package and for this reason must be attached to the side in a diagonal position if it is not to protrude beyond the edges of the package 12.

The package that has then been provided with adhesive spots 59 then passes into the area of the applicator device 10. Here the drinking straws 11 that are in their paper sleeves 23 and are to be attached to the package are ready in the compartmentalized wheel. The strip 24 that comes from the feed roller 25 is cut into individual paper strips with the help of the cut-off blade 44 and each of these strips then contains a drinking straw 11 and is held in a cell 33 arranged on the circumference 32 by means of a vacuum.

As soon as the front edge of a package 12 reaches the photoelectric cell 61 a pulse is sent to a compressed air valve (not shown) which permits a burst of compressed air to emerge from the nozzle 55 and this swings the applicator arm 41 against the force of the spring 51. When this happens the two front ends 40 of the fork-shaped arm 41*a* of the applicator lever 41 move forward against the drinking straw 11 that is opposite the package and thrusts this against the side 60 of the package 12 which is opposite the compartmentalized wheel 20; the package supported on its opposite side 66 by means of a guide rail 67 that is secured to the conveyor belt 13.

As soon as the burst of compressed air has passed the air nozzle 55 the spring 51 draws the applicator arm 41 back into its initial position in which the free end 52 of its arm 41*b* once again on the edge 53 of the outlet opening 54 of the air nozzle 55. The compartmentalized wheel 20 is then moved forward in its direction of rotation by one cell division by its drive system so that the subsequent drinking straw 11 is moved into a position parallel to the conveyor belt 13 and the next drinking straw sleeve 23 can be cut off by the cut-off knife 44 from the strip 24 that comes from the feed roller 25.

Figure 2:
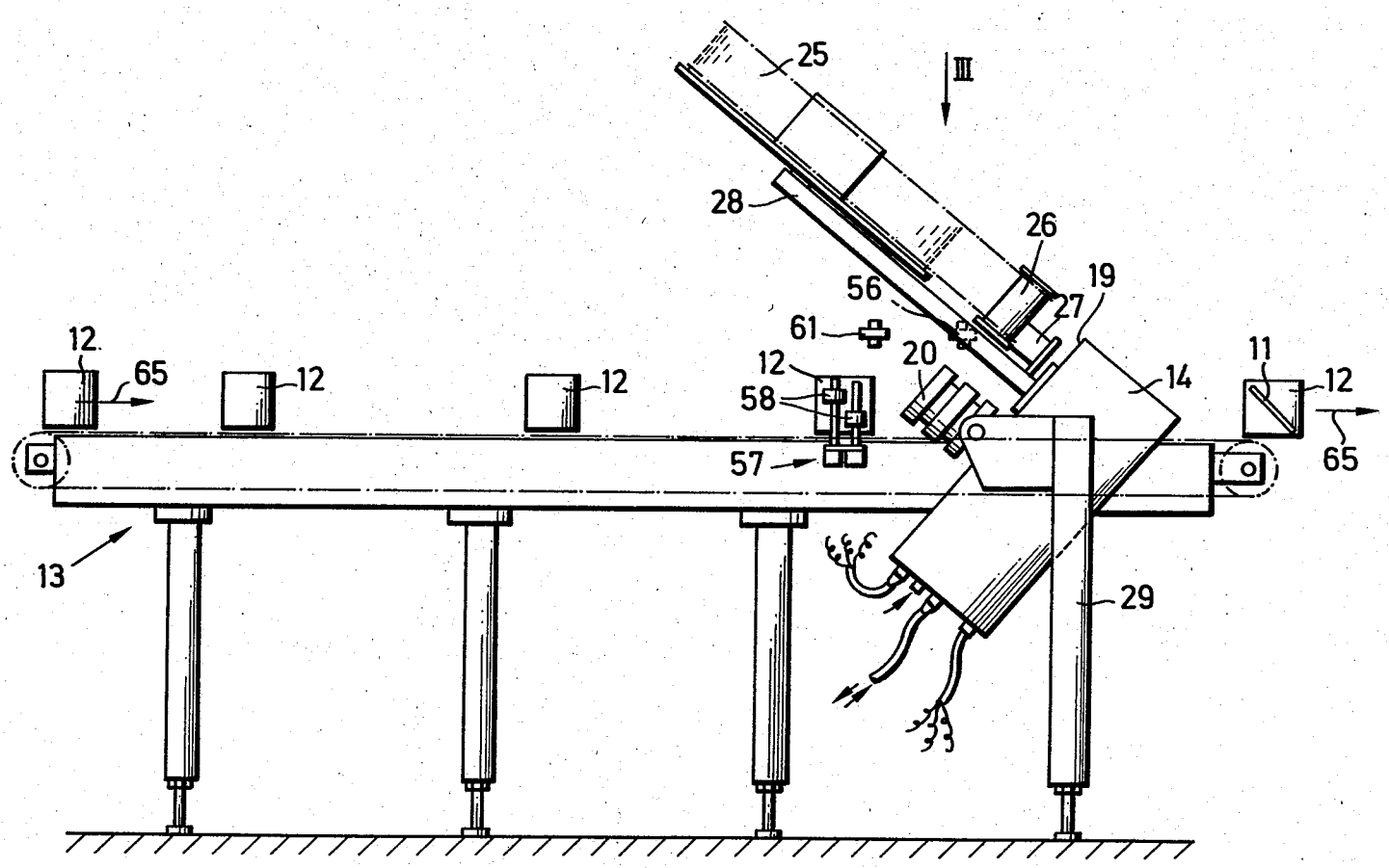
Figure 3:
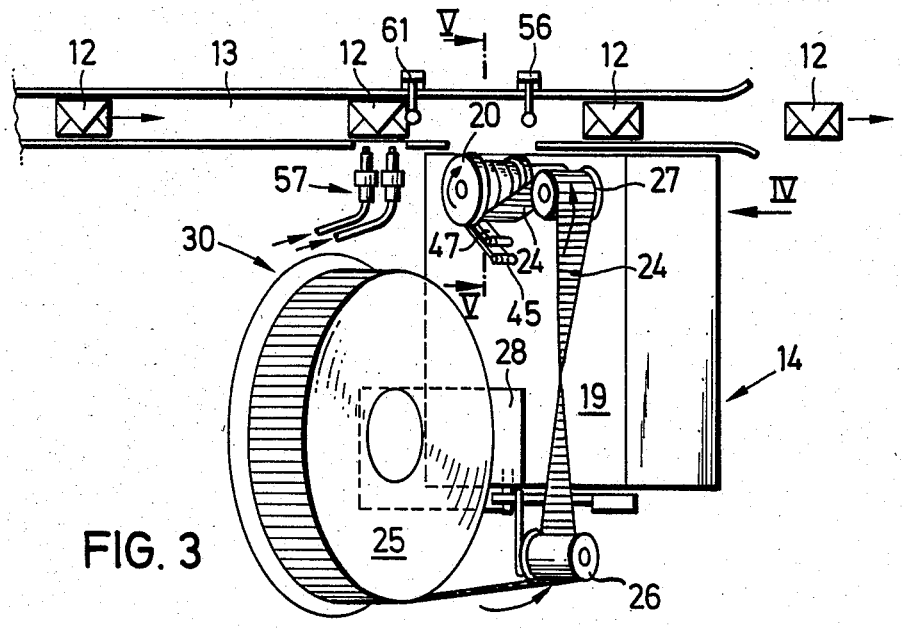
Figure 7:
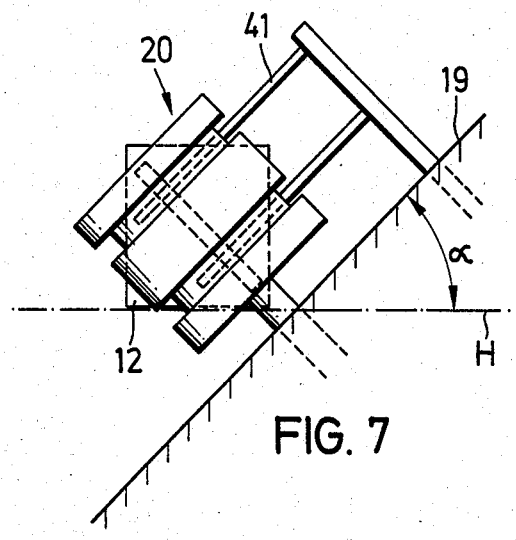
FIGS. 7 and 8 The attachment device inside elevation in two different tipped positions, FIG. 9 The attachment device in a front view in another tipped position, in a schematic representation, FIG. 10 Another exemplary version of the applicator element that works in conjunction with the compartmentalized wheel in an illustration that corresponds to FIG. 6.
Figure 8:
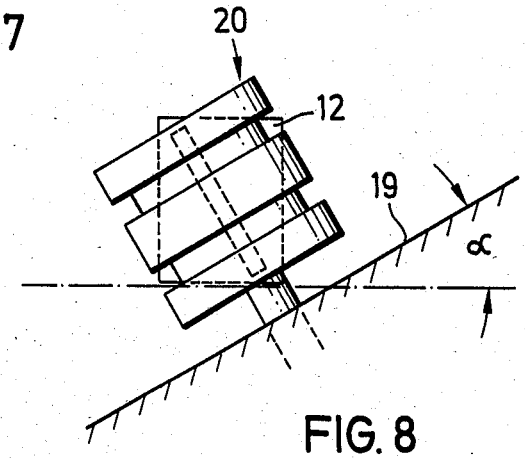

From FIGS. 2, 7 and 8 it can be seen that the applicator device 10 can be tilted about the axis 15 in such a manner that the compartmentalized wheel 20 with the applicator arm 41 can be inclined at various angles $\alpha$ to the horizontal these corresponding to different diagonal directions on packages of different heights.

Figure 9:
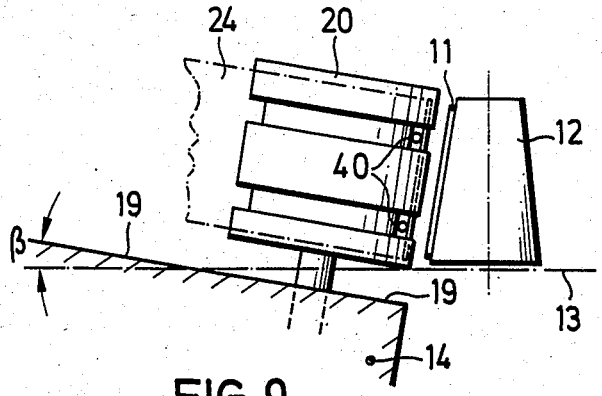

FIG. 9 shows that it is also possible to attach articles to packages that have sides 60 that are inclined to the base surface. In this case the area 14 must be swivelled about its axis 16 in such a manner that the upper side 19 of the carrier 14 forms the angle $\beta$ with the horizontal plane.

Figure 10:
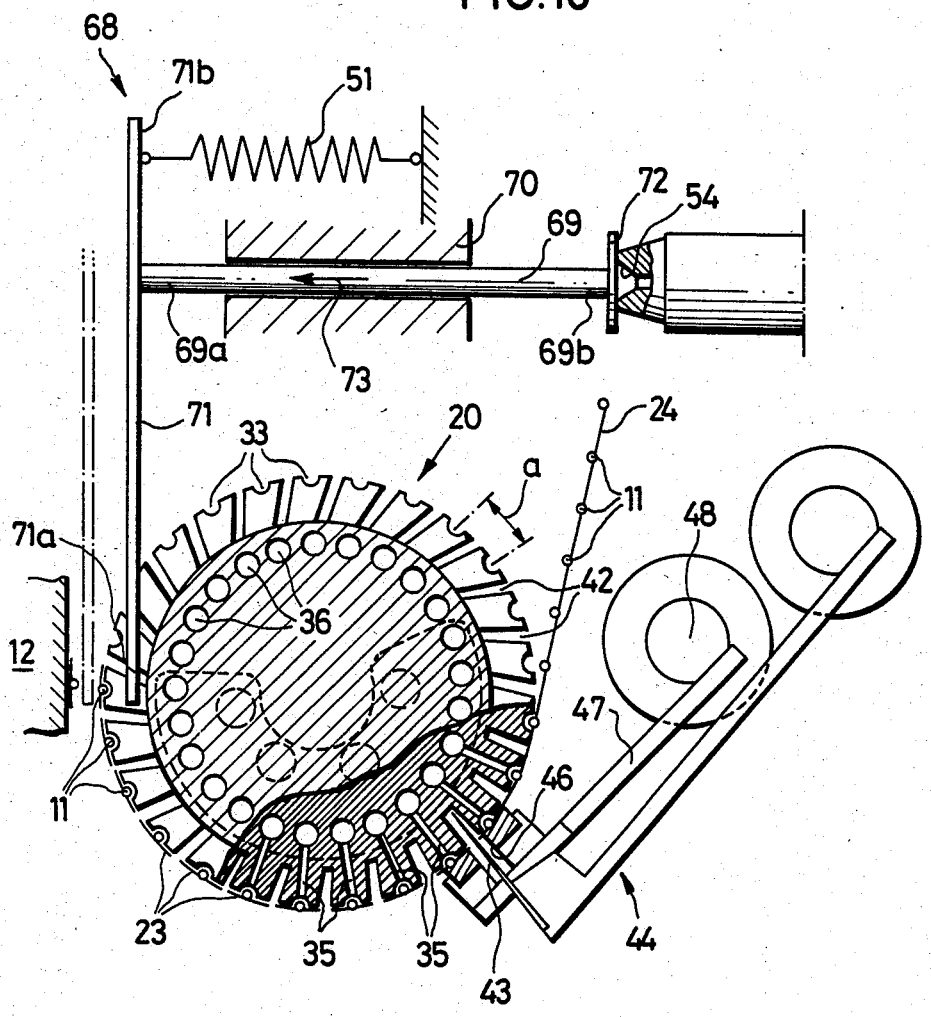

In the other version of the applicator device shown in FIG. 10 the applicator element consists of an applicator push rod 68, the shaft 69 of which is installed in a bracket 70 on the carrier 14 in such a manner as to permit axial movement which on its front end 69*a* that faces the conveyor belt 13 has a feed element 71 and at its rear end 69*b* has a blocking plate 72 which closes off the outlet opening 54 of the air nozzle 55. The feed element 71 is configured in the version shown here as a fork arm one fork-shaped end 71*a* of which slides in the two annular grooves 39 of the compartmentalized wheel 20 and which at the other end 71*b* is connected to a spring 51 which attempts to draw back the applicator push rod 68 against its direction of advance 73 and thereby push the blocking plate 72 against the outlet opening 54 of the air valve 55. In order that the applicator push rod 68 is loaded symmetrically two springs 51 can also be provided these being attached to both sides of the push rod shaft 69 and being attached at equal intervals from this to the advance element 71.

If a package 12 passes the compartmentalized wheel 20 and the photoelectric cell 56 opens the air nozzle 55 for a brief period the blocking plate 72 is acted on by a burst of compressed air that displaces the applicator push rod 68 in the direction of the arrow 73 against the action of the spring 51. The front end 71*a* of the advance element 71 then slips behind the waiting straw and thrusts it against the package 12 where it and its paper sleeve 23 are cemented to the spots of cement 55 previously applied to the package 12.

The invention is not confined to the exemplary version shown here; there are several modifications and changes possible that still remain within the context of this invention. For example using the device that is shown it is possible to cement not only drinking straws, but also other articles such as labels, advertising articles, or the like to packages, bottles or other objects. When this is done the external configuration of the object plays no part since it is possible to tilt the applicator device around perpendicular axes in order that the article that is to be applied can be brought into a position that is parallel to the surface of the object to which the article is to be applied. Neither is it absolutely essential that the cement spots are applied to the object since the articles that are to be applied can be provided with a self-adhesive layer so that they are cemented directly to the objects if they are thrust against them by the applicator arm. Furthermore, it is possible to use another device for preparing the articles that are to be applied and to use mechanical, electrical or pneumatically operated push rods as thrust devices.

I claim:

1. Apparatus for applying accessory articles to objects moving past an application station at intervals, comprising:

support means at said application station;

applicator means on said support means and displaceable between retracted and extended positions relative to an object at said application station, said applicator means comprising a pivoted lever having a first arm portion for engaging and thrusting said accessory article across a space and onto said object and a second arm portion;

means for bringing an accessory article into a confronting position with the object at said application station comprising a compartmentalized wheel rotatably mounted on said support means and having compartments arranged around its outer surface for receiving articles and at least one annular groove behind articles in said compartments, said first arm portion of said applicator means being accommodated in said annular groove in said retracted position of said applicator means, whereby said first arm portion in moving from said retracted to said extended position displaces an article out of its respective compartment and thrusts said displaced article across said space and onto said object;

a compressed air nozzle for directing a blast of compressed air directly against said second arm portion of said applicator means to displace said applicator means from said retracted position to said extended position; and biasing means for urging said applicator means from said extended to said retracted position.

2. The apparatus as recited in claim 1, wherein said second portion of said pivoted lever closes the outlet opening of said air nozzle when said applicator means is in said retracted position.

3. Apparatus according to claim 1, wherein said means for bringing an article into a confronting position with an approaching object and said applicator means are mounted on said support means, said support means being mounted at said application station for selective tilting adjustment about orthogonal axes.

4. Apparatus according to claim 1, wherein said biasing means is provided by a spring.

5. Apparatus according to claim 1, and means for sensing an approaching object and actuating said compressed air nozzle, comprising sensors arranged in the path of the objects, and means responsive to said sensors for controlling air flow to said compressed air nozzle.

6. Apparatus for applying accessory articles to objects moving past an application station of the apparatus at intervals, comprising:

support means at said application station;

means for bringing an accessory article into a confronting position with the approaching object at said application station comprising a compartmentalized wheel rotatably mounted on said support means and having compartments arranged around its outer surface for receiving articles and at least one annular groove behind articles in said compartments;

applicator means on said support means and displaceable between retracted and extended positions relative to an object at said application station, said applicator means having at least one arm accommodated in said annular groove in said retracted position of said applicator means, whereby said one arm in moving from said retracted to said extended position displaces an article out of its respective compartment and thrusts said displaced article across a space and onto said object;

push rod means having opposite ends, said one arm being on one of said ends of said push rod means, a compressed air nozzle for directing a blast of compressed air against the other end of said push rod means to displace said one arm from said retracted to said extended position; and biasing means urging said one arm from said extended to said retracted position.

7. The apparatus as recited in claim 6, wherein said other end of said push rod means includes a blocking plate against which compressed air form said air nozzle is directed to displace the applicator means from said retracted to the said extended position, said blocking plate closing the outlet opening of said air nozzle when said applicator means is in said retracted position.

8. Apparatus according to claim 6, wherein said means for bringing an article into a confronting position with an approaching object and said applicator means are mounted on said support means, said support means being mounted at said application station for selective tilting adjustment about orthogonal axes.

9. Apparatus according to claim 6, wherein said biasing means is provided by a spring.

10. Apparatus according to claim 6, and means for sensing an approaching object and actuating said compressed air nozzle, comprising sensors arranged in the path of the objects, and means responsive to said sensors for controlling air flow to said compressed air nozzle.

11. Apparatus for applying accessory articles to objects moving past an application station at intervals, comprising:

support means at said application station;

an applicator on said support means having spaced apart article displacing and applicator actuating ends, said article displacing end being displaceable between retracted and extended positions relative to an object at said application station;

means for locating an accessory article between said article displacing end of said applicator and an object at said application station;

biasing means urging said article displacing end of said applicator from said extended position to said retracted position; and compressed air means including nozzle means structurally separate from said applicator, said compressed air means directing a blast of compressed air through said nozzle means and directly against said actuating end of said applicator for a time sufficient for said blast of air to thrust said actuating end away from said nozzle means against the urging of said biasing means and said article displacing end from said retracted to said extended position, whereby said article displacing end of said applicator in moving from said retracted to said extended position thrusts said accessory article across a space onto said object at said application station.

* * * * *